US010596409B2

(12) United States Patent
Burck et al.

(10) Patent No.: US 10,596,409 B2
(45) Date of Patent: Mar. 24, 2020

(54) STAIR EXERCISER APPARATUS

(71) Applicants: Robert C Burck, Middleton, WI (US); Michael J Fidler, Madison, WI (US); Alexander E Hanson, Sun Prairie, WI (US); Noel R Johnson, Stoughton, WI (US); Mark J Kannel, Oconomowoc, WI (US)

(72) Inventors: Robert C Burck, Middleton, WI (US); Michael J Fidler, Madison, WI (US); Alexander E Hanson, Sun Prairie, WI (US); Noel R Johnson, Stoughton, WI (US); Mark J Kannel, Oconomowoc, WI (US)

(73) Assignee: Johnson Health Tech Co., Ltd., Taichung (TW)

( * ) Notice: Subject to any disclaimer, the term of this patent is extended or adjusted under 35 U.S.C. 154(b) by 139 days.

(21) Appl. No.: 15/964,006

(22) Filed: Apr. 26, 2018

(65) Prior Publication Data

US 2018/0243606 A1 Aug. 30, 2018

Related U.S. Application Data

(63) Continuation-in-part of application No. 15/135,556, filed on Apr. 22, 2016, now Pat. No. 9,993,682.

(51) Int. Cl.
*A63B 22/04* (2006.01)
*A63B 21/005* (2006.01)
(Continued)

(52) U.S. Cl.
CPC ..... *A63B 22/04* (2013.01); *A63B 21/0051* (2013.01); *A63B 21/0052* (2013.01); *A63B 21/157* (2013.01); *A63B 21/012* (2013.01); *A63B 21/015* (2013.01); *A63B 21/225* (2013.01); *A63B 24/0087* (2013.01);
(Continued)

(58) Field of Classification Search
CPC ... A63B 21/005; A63B 21/015; A63B 21/056; A63B 21/157; A63B 21/225; A63B 22/04
See application file for complete search history.

(56) References Cited

U.S. PATENT DOCUMENTS 3,592,466 A * 7/1971 Parsons ..... A63B 22/0023 482/53
4,687,195 A * 8/1987 Potts ..... A63B 21/015 482/52
(Continued)

*Primary Examiner* — Jennifer Robertson

(57) ABSTRACT

A stair exerciser apparatus for simulating stair climbing includes a frame, a lower shaft and an upper shaft mounted rotatably on the frame, a conveyor operatively engaged with the upper shaft and the lower shaft, a plurality of steps, a flywheel and a one-way clutch mechanism. The plurality of steps are joined to the conveyor for movement with the conveyor. The flywheel is operatively engaged with the conveyor. The one-way clutch mechanism is operatively engaged with the conveyor and the flywheel. The one-way clutch mechanism is configured to selectively couple the conveyor with the flywheel such that motion of the plurality of steps in a first step direction drives rotation of the flywheel when the one-way clutch mechanism is engaged, and the one-way clutch mechanism decouples the conveyor from the flywheel when the one-way clutch mechanism is disengaged.

20 Claims, 12 Drawing Sheets

(51) Int. Cl.

| | |
|---|---|
| ***A63B 21/00*** | (2006.01) |
| ***A63B 21/015*** | (2006.01) |
| ***A63B 21/22*** | (2006.01) |
| ***A63B 24/00*** | (2006.01) |
| ***A63B 71/06*** | (2006.01) |
| ***A63B 69/00*** | (2006.01) |
| ***A63B 71/00*** | (2006.01) |
| ***A63B 21/012*** | (2006.01) |

(52) U.S. Cl.
CPC ..... *A63B 69/0057* (2013.01); *A63B 71/0622* (2013.01); *A63B 2071/0081* (2013.01); *A63B 2230/06* (2013.01)

(56) References Cited

U.S. PATENT DOCUMENTS

| | | | | | |
|---|---|---|---|---|---|
| 5,328,420 | A * | 7/1994 | Allen | A63B 22/0023 | 482/37 |
| 5,556,352 | A * | 9/1996 | Chang | A63B 22/04 | 482/51 |
| 5,769,759 | A * | 6/1998 | Alter | A63B 22/04 | 482/37 |
| 2012/0264572 | A1 * | 10/2012 | Fenster | A63B 22/04 | 482/52 |

* cited by examiner

STAIR EXERCISER APPARATUS

CROSS-REFERENCE TO RELATED APPLICATION

This is a continuation-in-part of application Ser. No. 15/135,556, filed Apr. 22, 2016.

BACKGROUND

1. Field of the Invention

The present invention relates to an exercise apparatus. More particularly, the present invention relates to a stair exerciser apparatus for simulating stair climbing.

2. Description of the Related Art

In general, the stair exerciser apparatus is driven downward by an external load such as the weight of an operator standing upon the steps. The downward running speed of the steps is generally controlled by a braking mechanism. The braking mechanism may be an eddy current brake (ECB), a friction brake, or any other brake that is known in the art. For example, U.S. Pat. No. 4,927,136 discloses an electromagnetic brake that is utilized in the control of exercise equipment including escalator type stair-climbing apparatus, in which electronically controllable torque, including a clamping torque, is applied to a rotary shaft to load the exercise equipment, thereby giving complete electronic control to the operation of the exercise apparatus. Another example of a stair exerciser apparatus illustrated in U.S. Pat. No. 8,702,571 discloses a braking mechanism disposed next to a flywheel. The braking mechanism is controlled by control signals sent by a controller. The braking mechanism is adjustable so that the amount of braking force may be increased or decreased by the controller. As the flywheel rotates, the braking mechanism provides an opposing torque to the flywheel, thereby slowing down the rotation of the flywheel and the speed of the steps.

The braking mechanism of the conventional stair exerciser apparatus is generally actuated by means of electronic controls, namely, the resistance of the braking mechanism is controlled by a controller. However, if the stair exerciser apparatus were to lose power, the braking mechanism may cease to function such that the steps of the stair exerciser apparatus may be out of control. In order to prevent this occurrence, a safety device is important to stop the motion of the steps immediately.

A conventional stair exerciser apparatus generally has a plurality of steps that move in a downward direction during use of the stair exerciser apparatus. As each of these plurality of steps have reached the bottom of the stair exerciser apparatus, they must follow an endless conveyor underneath the stair exerciser apparatus to return to the top of the stair exerciser apparatus to allow them emerge again from the top portion of the stair exerciser apparatus. The plurality of steps of a conventional stair exerciser apparatus may hit some obstacle during the course of their travel, causing the possibility of entrapment, shear, or crush points. In order to prevent or minimize the damage that can be done by these moving steps, a safety device is important to minimize the loads and/or energy transmitted to the obstacle when this situation occurs. It is also desirable to enable the plurality of steps to be able to reverse in direction to extract any entrapped obstacle.

The present invention has arisen to mitigate and/or obviate the disadvantages of the conventional stair exerciser apparatus. Further benefits and advantages of the present invention will become apparent after a careful reading of the detailed description with appropriate reference to the accompanying drawings.

SUMMARY

The object of the present invention provides a stair exerciser apparatus with one or more safety mechanism to increase the safety of operators during exercise.

According to one embodiment of the present invention, a stair exerciser apparatus for simulating stair climbing includes a frame, a lower shaft, an upper shaft, a conveyor, a plurality of steps, a flywheel, a resistance mechanism, and a one-way clutch mechanism. The frame has a base, a front portion, and a rear portion. The lower shaft is rotatably mounted on the rear portion of the frame and the upper shaft is rotatably mounted on the frame located above and forward of the lower shaft. The conveyor is operatively engaged with the upper shaft and the lower shaft. The plurality of steps are joined to the conveyor for movement with the conveyor, and each of the plurality of steps is made up of a step platform and a riser pivotably joined to the step platform. The flywheel is operatively engaged with the conveyor and the resistance mechanism. The one-way clutch mechanism is operatively engaged with the conveyor and the flywheel. The one-way clutch mechanism selectively couples the conveyor with the flywheel such that motion of the plurality of steps in a first step direction drives rotation of the flywheel when the one-way clutch is engaged, and the one-way clutch mechanism decouples the conveyor from the flywheel when the one-way clutch is disengaged. Preferably, the one-way clutch mechanism selectively decouples the conveyor from the flywheel such that motion of the plurality of steps in a second step direction does not drive rotation of the flywheel.

Preferably, the stair exerciser apparatus further includes a controller, a locking mechanism operatively engaged with the conveyor, a braking mechanism operatively engaged with the flywheel, a flywheel speed sensor disposed to sense a rate of rotation of the flywheel and to generate flywheel speed data, and a conveyor speed sensor disposed to sense a motion speed of the plurality of steps and to generate step speed data. The controller receives the flywheel speed data and the step speed data. The controller engages the braking mechanism to slow the rate of rotation of the flywheel if the controller determines from the flywheel speed data and from the step speed data that the motion of the plurality of steps is no longer driving the rotation of the flywheel due to the one-way clutch mechanism being disengaged.

Preferably, the one-way clutch mechanism is operatively engaged with the plurality of steps such that when the braking mechanism is disengaged, a load applied to the steps in a downward direction engages the one-way clutch mechanism such that downward motion of the plurality of steps drives the rotation of the flywheel in a first rotational direction. The one-way clutch mechanism is operatively engaged with the plurality of steps such that the plurality of steps may be stopped or rotated in an opposite, upward direction when the one-way clutch mechanism is disengaged, regardless of whether or not the braking mechanism is engaged or disengaged, and regardless of the rotation or lack of rotation of flywheel. Since a rotating flywheel stores energy, the one-way clutch mechanism also will disengage the plurality of steps from the flywheel to prevent transfer of the stored energy in the flywheel to the plurality of steps in the event that an obstacle stops the motion of the plurality of steps or otherwise prevents the rotation of the plurality of steps.

Further benefits and advantages of the present invention will become apparent after a careful reading of the detailed description with appropriate reference to the accompanying drawings.

DETAIL DESCRIPTION

In the following detailed description, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

Figure 1:
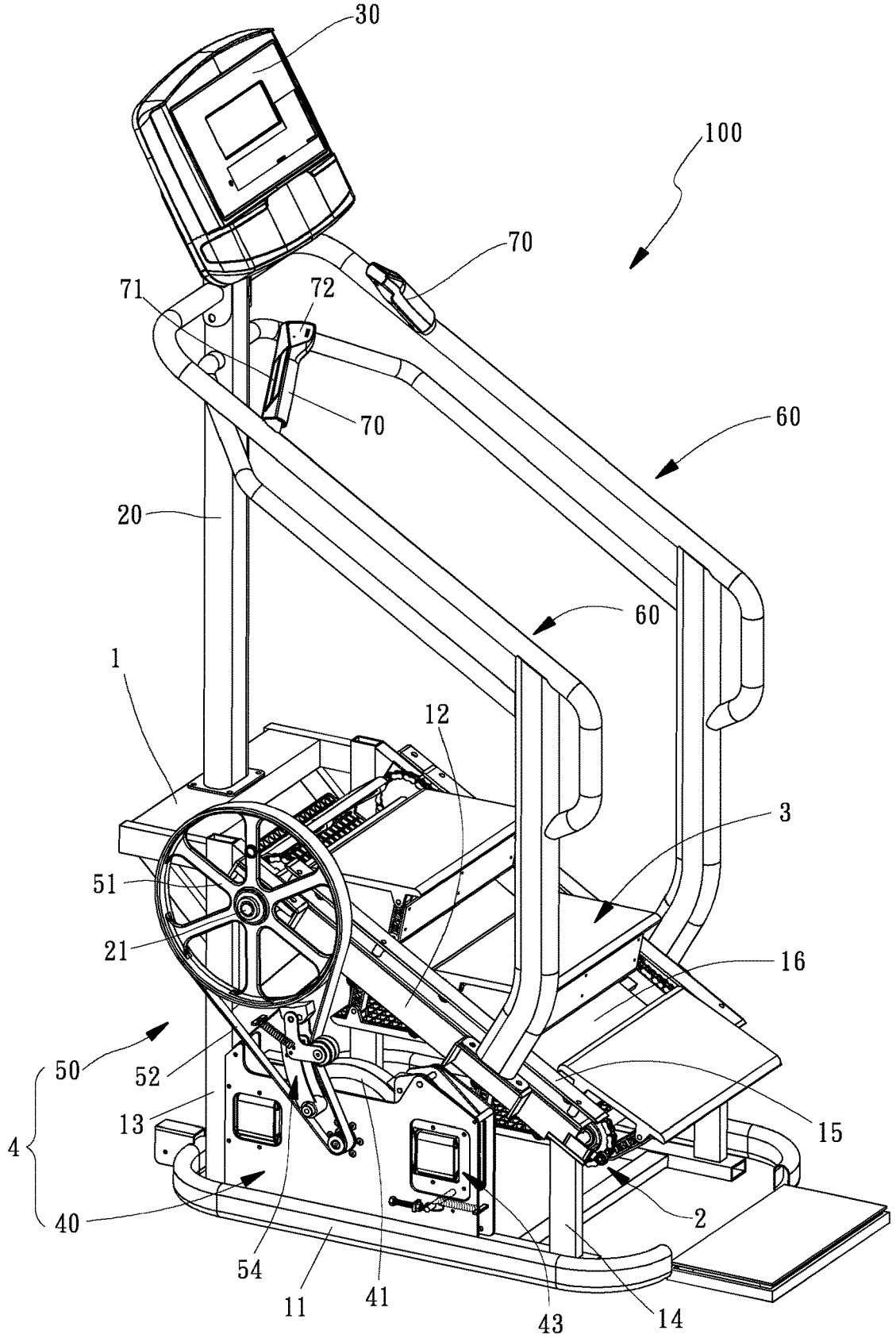
FIG. 1 is a perspective view of a stair exerciser apparatus in accordance with a preferred embodiment of the present invention.
Figure 2:
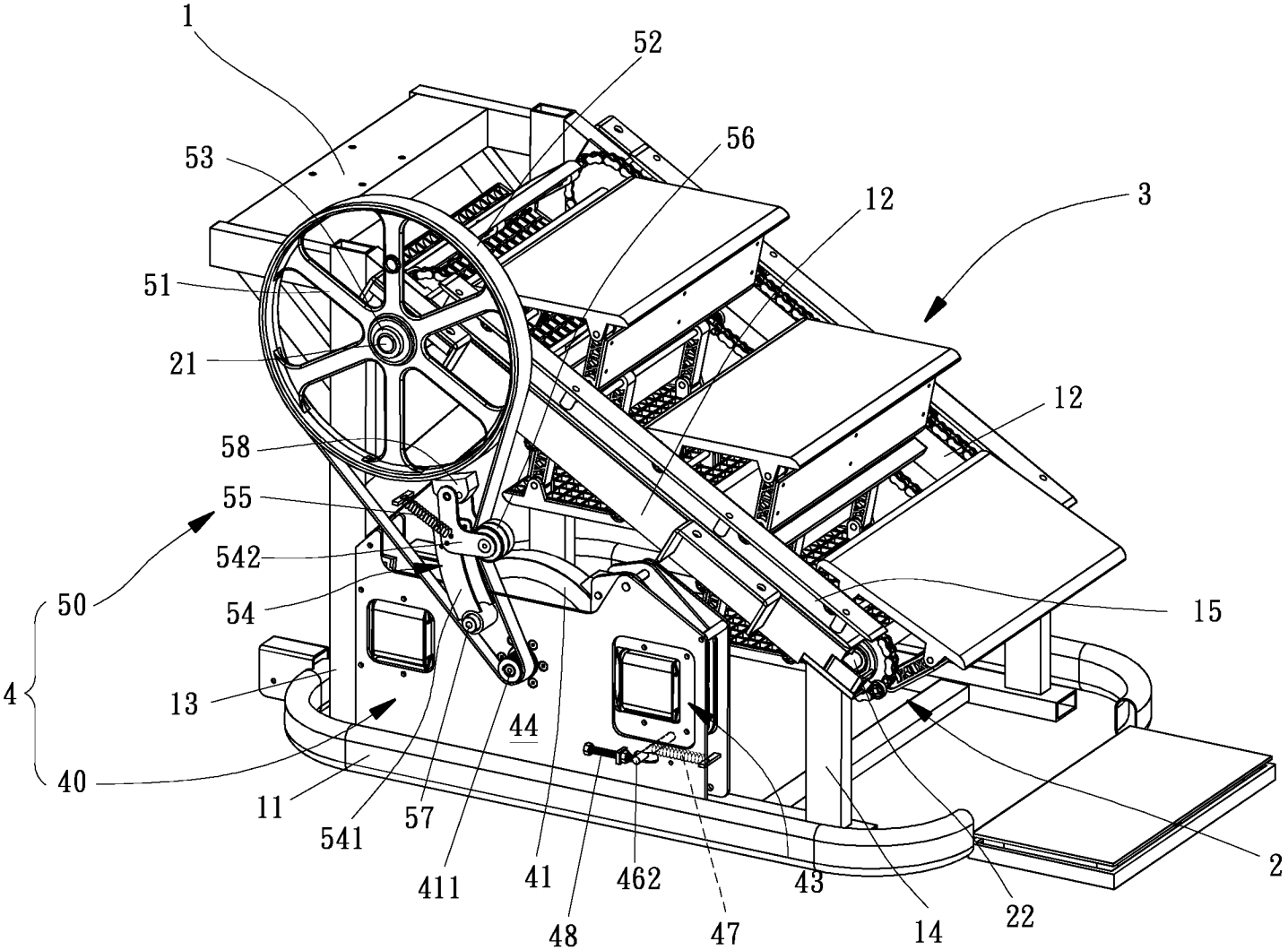
FIG. 2 is a lower assembly of the stair exerciser apparatus shown in FIG. 1.
Figure 3:
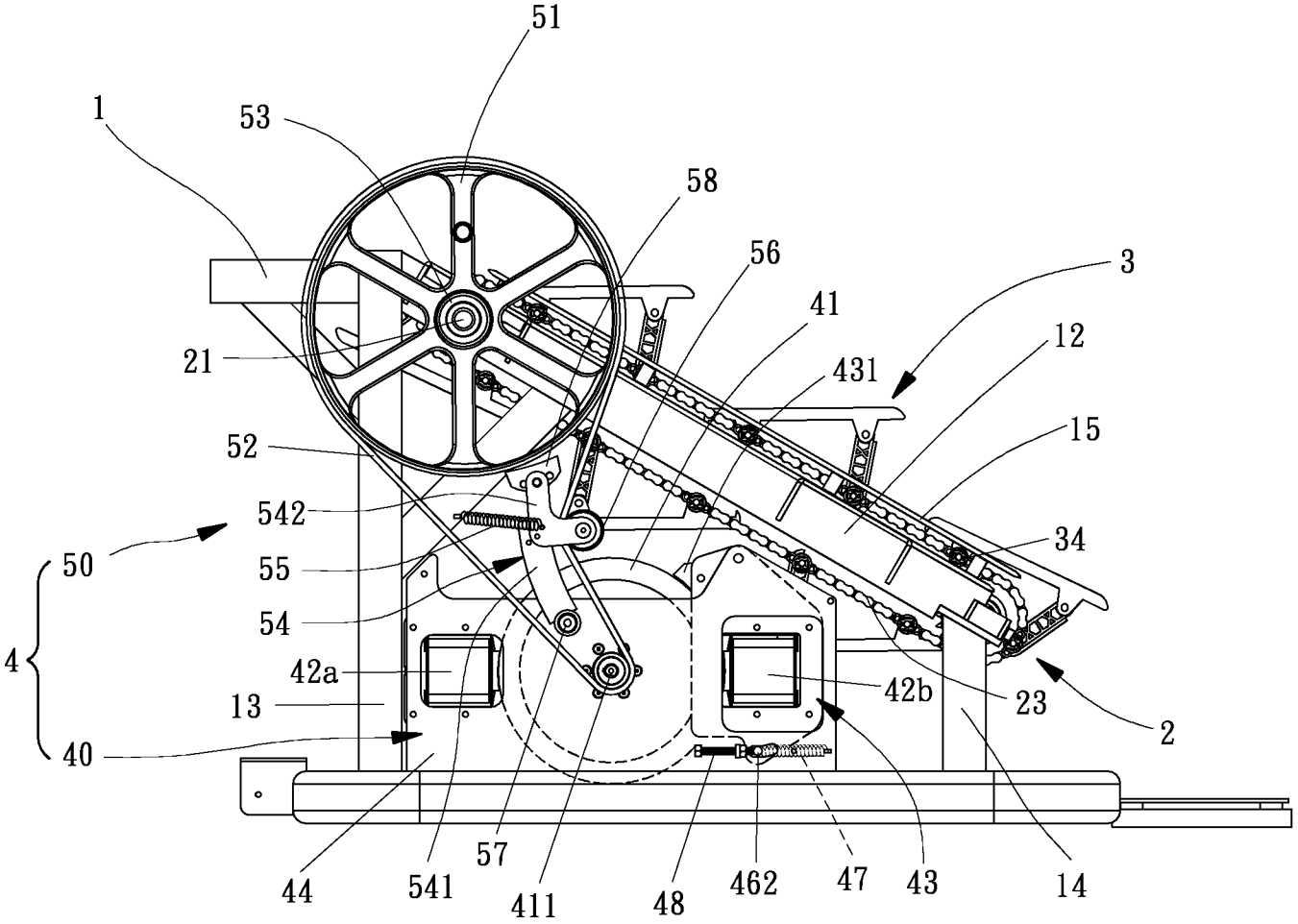
FIG. 3 is a side view of FIG. 2.

Referring to FIG. 1 through FIG. 3, a preferred embodiment of a stair exerciser apparatus 100 for simulating stair climbing is illustrated below. The stair exerciser apparatus 100 includes a lower assembly which includes a frame 1, a drive mechanism 2, a plurality of steps 3 and a resistance mechanism 4. The frame 1 has a base 11 resting on a substantially horizontal support surface such as a floor and a pair of inclined supports 12 slanted downward from a front portion of the frame 1 to a rear portion of the frame 1. The base 11 of the frame 1 is substantially U-shaped with an open end toward the rear portion of the stair exerciser apparatus 100. The pair of inclined supports 12 are disposed at two opposite sides of the frame 1 for supporting the drive mechanism 2 and the plurality of steps 3. Each inclined support 12 is supported by a front post 13 and a rear post 14. The front post 13 and the rear post 14 are mounted upright on the base 11 and the length of the front post 13 is longer than the length of the rear post 14 such that each inclined support 12 is inclined from the front portion of the frame 1 to the rear portion of the frame 1.

As shown in FIG. 1, the stair exerciser apparatus 100 includes a console mast 20 for supporting a console 30 above the front portion of the frame 1, two handrails 60 defined at opposite sides of the stair exerciser apparatus 100 and two grip members 70 respectively mounted to the two handrails 60. The console mast 20 is mounted upright on a top plane of the frame 1. The console 30 includes a display screen to provide feedback to an operator and to receive commands from the operator. The two handrails 60 are mounted to the respective inclined supports 12 of the frame 1 for allowing an operator to hold while he/she walks up or down the plurality of steps 3, and an entrance is defined between the two handrails 60 at the rear portion of the stair exerciser apparatus 100 to allow the operator to enter or exit from the stair exerciser apparatus 100. Each grip member 70 has a heart rate monitor 71 built into the grip member 70. In the preferred embodiment, each grip member 70 has control buttons 72 incorporated into the grip member 70. The control buttons 72 on each grip member 70 can include controls such as speed control, resistance control, start, stop, and pause.

Figure 6:
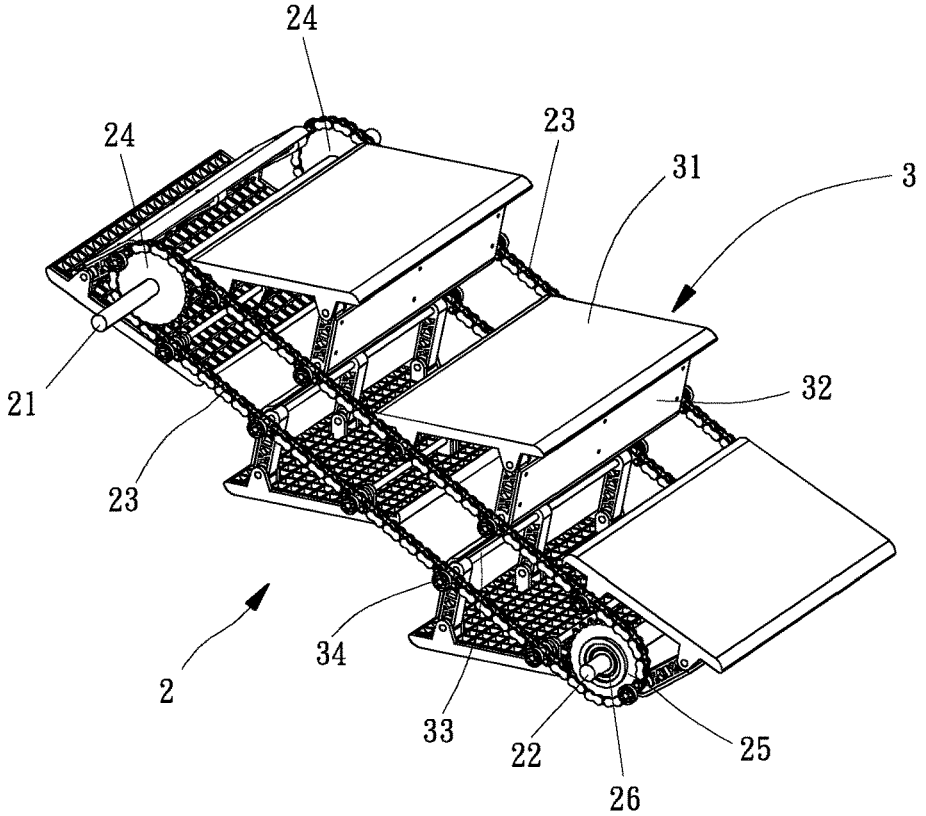
FIG. 6 is a perspective view of the drive mechanism with a plurality of steps.

As shown in FIG. 2 and referring to FIG. 6, the drive mechanism 2 has an upper shaft 21 rotatably mounted to the frame 1 at an upper portion of the pair of inclined supports 12 and a lower shaft 22 rotatably mounted to the frame 1 at a lower portion of the pair of inclined supports 12. A pair of upper sprockets 24 are operatively connected to the upper shaft 21 and a pair of lower sprockets 25 are operatively connected to the lower shaft 22. In the preferred embodiment, a pair of drive chains 23 which are mounted around the upper sprocket 24 and the lower sprocket 25 at opposite sides for revolving around the pair of inclined supports 12. The plurality of steps 3 are coupled to the pair of drive chains 23 for synchronously revolving around the pair of inclined supports 12 such that the plurality of steps 3 are movable along the pair of inclined supports 12. Specifically, the plurality of steps 3 are disposed along the pair of drive chains 23. In the preferred embodiment as depicted in FIG. 6, the plurality of steps 3 are spaced apart along the pair of drive chains 23 such that every adjacent two of the plurality of steps 3 are spaced apart at a set distance. However, in another embodiment, the plurality of steps could be connected together in series around the inclined supports, which is not limited by the present invention.

Referring to FIG. 2 and FIG. 3, the resistance mechanism 4 is coupled to the drive mechanism 2 for controlling the rotational motion of the plurality of steps 21. The resistance mechanism 4 is configured to adjust and control the rotational resistance of the upper shaft 21 or the lower shaft 22 so as to adjust and control the downward running speed of the plurality of steps 3. In the preferred embodiment of the present invention, the resistance mechanism 4 is coupled to the upper shaft 21 of the drive mechanism 2. The resistance mechanism 4 includes an electromagnetic resistance device 40 and a pulley assembly 50. The pulley assembly 50 has a pulley 51 coupled to the upper shaft 21 and a belt 52 connecting the pulley 51 and the electromagnetic resistance device 40 for operatively engaging the pulley 51 with the electromagnetic resistance device 40 such that the rotational motion of the pulley 51 is adjusted and controlled by the electromagnetic resistance device 40 so as to adjust and control the downward running speed of the plurality of steps 3.

Figure 4:
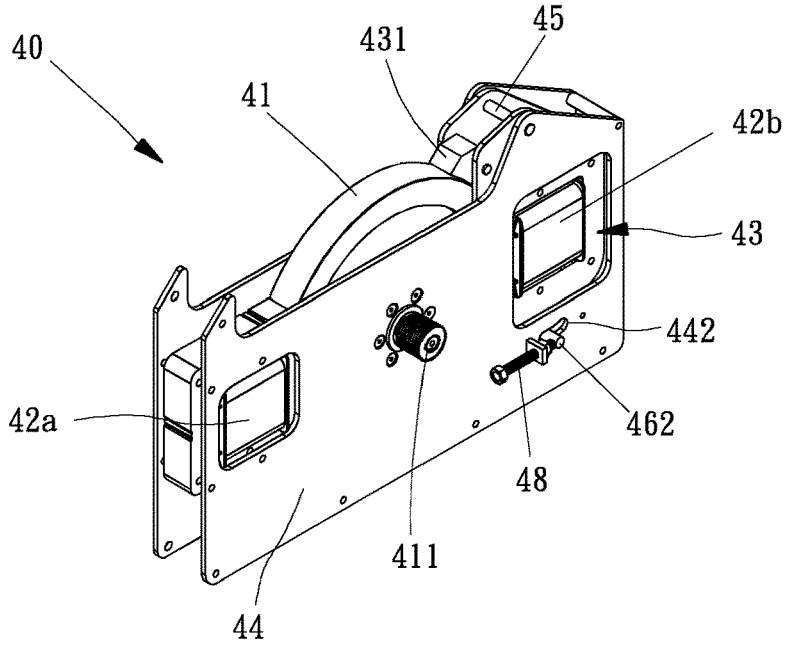
FIG. 4 is a perspective view of the electromagnetic device
Figure 5:
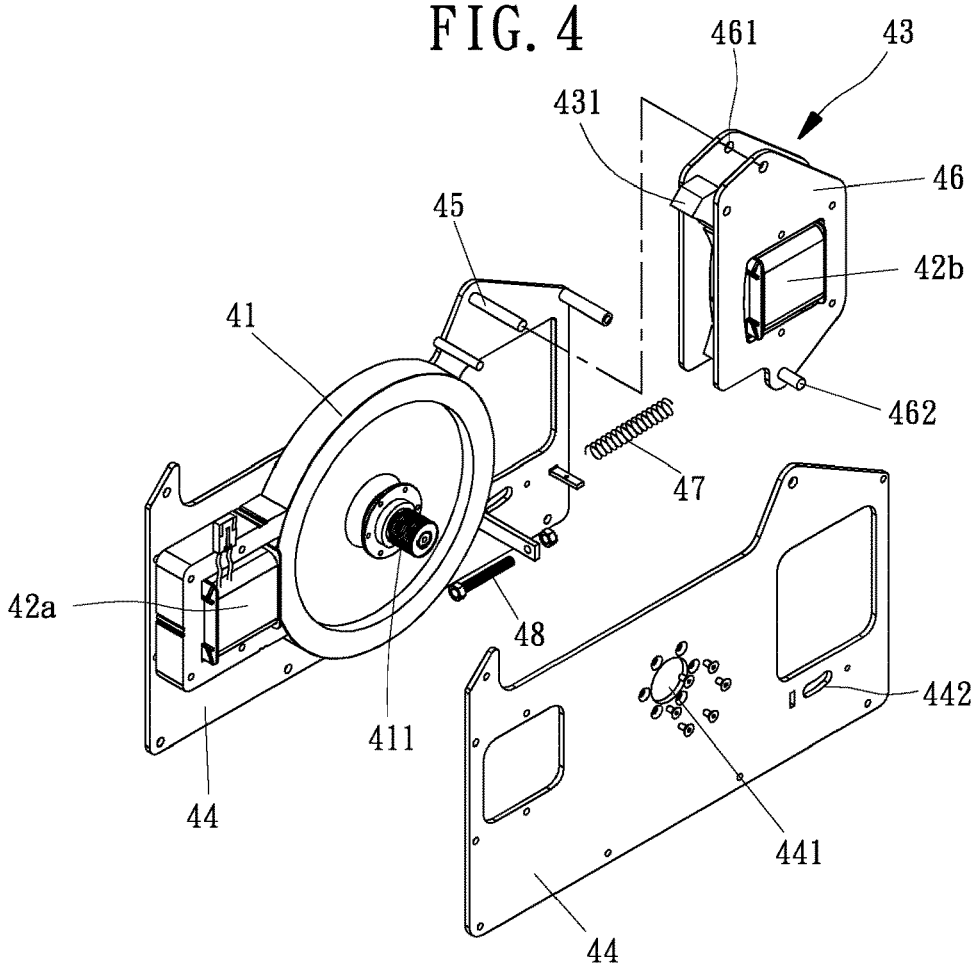
FIG. 5 is an exploded perspective view of the electromagnetic device shown in FIG. 4.

Referring to FIG. 4 and FIG. 5, in the preferred embodiment of the present invention, the electromagnetic resistance device 40 is an electromagnetic brake system such as an eddy current brake (ECB) which includes a flywheel 41, a first electromagnet 42*a* and a second electromagnet 42*b* respectively disposed at two opposite sides of the flywheel 41 and corresponding to an outer periphery of the flywheel 41 for electrically controlling the rotational resistance to rotation of the flywheel 41. Rotation of the pulley 51 rotates the belt 52 that is connected to and rotates the flywheel 41 about a central shaft 411. As shown in FIG. 2, the belt 52 is mounted around the pulley 51 and the central shaft 411 of the flywheel 41 for operatively coupling the pulley 51 with the flywheel 41. The two electromagnets 42*a*, 42*b* provide a drag force to stop or slow down rotation of the flywheel 41 so as to control the downward running speed of the plurality of steps 3. Specifically, the electromagnetic resistance device 40 further includes a brake unit 43 which is coupled with one of the two electromagnets 42*a*, 42*b*. As shown in FIG. 4, the first electromagnet 42*a* is located next the flywheel 41 and the second electromagnet 42*b* is coupled with the brake unit 43 so that the second electromagnet 42*b* and the brake unit 43 are movable simultaneously with respect to the flywheel 41. The brake unit 43 has a brake block 431 configured to stop rotation of the flywheel so as to stop the plurality of steps 3. Under this arrangement, the brake unit 43 is movable between a non-braking position where the brake block 431 is pulled away from the flywheel 41 when the second electromagnet 42*b* is energized and a braking position where the brake block 431 is pulled into contact with the flywheel 41 to brake the flywheel 41 when the second electromagnet 42*b* is turned off or when the electromagnetic resistance device 40 experiences a loss of power.

As shown in FIG. 4 and FIG. 5 and referring to FIG. 2, the electromagnetic resistance device 40 has two spaced apart retaining plates 44 secured to the base 11 of the frame 1 for retaining the flywheel 41. The two retaining plates 44 are arranged opposite to each other to define an inner space for receiving the flywheel 41, the first electromagnet 42*a*, and the brake unit 43. The brake unit 43 also includes a second electromagnet 42*b*. The flywheel 41 is sandwiched between the two retaining plates 44. The central shaft 411 of the flywheel 41 passes through an opening 441 of each of the two retaining plates 44 such that the flywheel 41 is supported by the two retaining plates 44 and rotatable within the two retaining plates 44. In the preferred embodiment, the first electromagnet 42*a* is secured in between the two retaining plates 44 at one side of the flywheel 41, as depicted in FIG. 5. The brake unit 43 is pivotally connected between the two retaining plates 44 via a pivot pin 45. The pivot pin 45 is fixed between the two retaining plates 44 to enable the brake unit 43 to pivot on the pivot pin 45. In this manner, the brake unit 43 is pivotable relative to the outer periphery of the flywheel 41 to push the brake block 431 into contact with the outer periphery of the flywheel 41, or to pull the brake block 431 away from the outer periphery of the flywheel 41.

Referring to FIG. 5, the brake unit 43 has two side plates 46 spaced a distance apart. The second electromagnet 42*b* is sandwiched in between the two side plates 46. The brake block 431 is pivotally mounted between the two side plates 46 at the upper portion of the brake unit 43 with the brake block 431 facing toward the outer periphery of the flywheel 41. Each side plate 46 has a pivot hole 461 defined at the upper portion thereof The pivot pin 45 passes through the pivot hole 461 of each side plate 46 and is secured to the two retaining plates 44 so that the brake unit 43 is pivotable about the pivot pin 45. Since the second electromagnet 42*b* is coupled with the brake unit 43, the brake unit 43 and the second electromagnet 42*b* can be moved together.

In the preferred embodiment of the present invention, the flywheel 41 has magnetic properties, for example, the flywheel 41 may be made out of a ferromagnetic substance or integrated with ferromagnetic substances. When the electromagnetic resistance device 40 is powered, the two electromagnets 42*a*, 42*b* are energized simultaneously. When the second electromagnet 42*b* is energized, the second electromagnet 42*b*, attracted to the ferromagnetic flywheel 41, would slightly move toward the flywheel 41 to approach the outer periphery of the flywheel 41 due to the magnetic attraction between them. As the second electromagnet 42*b* approaches the flywheel 41 due to the magnetic fields generated by the second electromagnet 42*b* when the second electromagnet 42*b* is energized, the brake unit 43 simultaneously moves toward the flywheel 41. Due to the construction of the brake unit 43 and the brake block 431, motion of the brake unit 43 toward the flywheel 41 counterintuitively pulls the brake block 431 away from the flywheel 41, disengaging the brake block 431 and allowing the flywheel 41 to rotate freely. In contrast, once power is lost, the brake unit 43 is pulled away from the flywheel by a spring 47. As the brake unit 43 is pulled away from the flywheel 41, the construction of the brake unit 43 pushes the brake block 431 into the braking position such that the brake block 431 is driven into the flywheel 41 to stop rotation of the flywheel 41.

In the preferred embodiment of the present invention, when there is no power, or a loss of power to the brake unit 43, the brake unit 43 is pulled away from the flywheel by a spring 47. Counterintuitively, the construction of the brake unit 43 causes the brake block 431 to press against the flywheel 41 when the brake unit 43 moves away from the flywheel 41, so that no power, or a loss of power to the brake unit 43 causes the brake block 431 to engage with the flywheel 41, bringing the flywheel 41 to a stop when there is a loss of power. As shown in FIG. 5, the brake unit 43 has a post 462 extending through the two side plates 46 at the lower portion of the brake unit 43. The spring 47 has one end secured to the post 462 and the other end anchored to the two retaining plates 44 via any fixing member. The spring 47 is configured to bias the brake unit 43, pivotally rotating the brake unit 43 into the braking position to push the brake block 431 into the flywheel 41, thereby applying a braking force to the flywheel 41 to stop rotation of the flywheel 41 as well as stopping revolution of the plurality of steps 3. Specifically, each retaining plate 44 has a slot 442 corresponding to the post 462 of the brake unit 43. As shown in FIG. 4 and referring to FIG. 2, the post 462 is projecting outward from each side plate 46, projecting through each retaining plate 44 via the slot 442. The slot 442 allows the brake unit 43 to rotate toward the flywheel 41 to the non-braking position, or away from the flywheel 41 such that the brake block 431 is rotated into the braking position. The slot 442 restricts the rotation angle of the brake unit 43. A minimum gap between the second electromagnet 42*b* and the flywheel 41 may be set by an adjusting screw 48 which is mounted to a tab protruding from the respective retaining plate 44. The adjusting screw 48 is configured to limit the forward motion of the post 462 in the slot 442 so as to set the minimum gap between the second electromagnet 42*b* and the flywheel 41.

Referring to FIG. 1 through FIG. 3, the electromagnetic resistance device 40 is mounted to the frame 1 and controlled by a controller (not shown). The electromagnetic resistance device 40 is adjustable so that the amount of resistance or braking force may be increased or decreased by the controller. The flywheel 41 is operatively connected by the belt 52 and the pulley 51 to the upper shaft 21. As the plurality of steps 3 of the stair exerciser apparatus 100 are driven downward by an external load such as the weight of an operator standing upon one or more of the plurality of steps 3, the drive chains 23 revolve about the upper shaft 21 and the lower shaft 22, causing the upper shaft 21 to rotate. Rotation of the upper shaft 21 drives rotation of the pulley 51. As the pulley 51 rotates, the electromagnetic resistance device 40 provides an opposing torque to the pulley 51, thereby slowing down rotation of the pulley 51 and the speed of the plurality of steps 3.

The brake unit 43 of the electromagnetic resistance device 40 is a safety mechanism used when there is no power or a loss of power so as to prevent the plurality of steps 3 from moving when there is a lack of power. In the event of a loss of power, the second electromagnet 42*b* will cease to function, allowing the spring 47 to bias the brake block 431 to be engaged with the flywheel 41. The brake unit 43 is designed as an emergency stop brake to stop the plurality of steps 3 by itself in case the power to the stair exerciser apparatus 100 is lost. Since the resistance applied to the flywheel 41 may be lost suddenly during a loss of power, causing the plurality of steps 3 to revolve with no resistance, this emergency stop feature is extremely important to the safety of the operators of any stair exerciser apparatus such as the stair exerciser apparatus 100. In order to reduce the risk of an operator from falling from the plurality of steps 3 of the stair exerciser apparatus 100, the safety mechanism is necessary. Additionally, a locking mechanism (not shown) may be coupled to the upper shaft 21. When the plurality of steps 3 are stationary, the locking mechanism is engaged by the controller to ensure the plurality of steps 3 remain stationary.

Referring to FIG. 2 and FIG. 3, the pulley 51 is connected to the upper shaft 21 by a one-way clutch mechanism 53. In the preferred embodiment of the present invention, the one-way clutch mechanism 53 is a one way clutch or a uni-directional clutch which would transmit torque in one direction and freewheel in the opposite direction. The one-way clutch mechanism 53 allows the upper shaft 21 to engage the pulley 51 to rotate in a first rotational direction and to disengage the pulley 51 in a second, opposite rotational direction. The one-way clutch mechanism 53 is configured to engage the pulley 51 in a clutched rotational direction and freewheel in an unclutched rotation direction. For example, when the plurality of steps 3 are driven downward by the operator, the upper shaft 21 is rotated in a clockwise direction as seen from the left side of the stair exerciser apparatus 100 as shown in FIG. 2 and FIG. 3. The motion of the plurality of steps 3 in the downward direction drives the one-way clutch mechanism 53 to engage, driving the pulley 51 to rotate. Rotation of the pulley 51 drives the flywheel 41 to rotate via the belt 52. The electromagnetic resistance device 40 is coupled with the pulley 51 through the flywheel 41 to provide an opposing torque to the upper shaft 21 so as to slow down the downward running speed of the plurality of steps 3. Therefore, the downward running speed of the plurality of steps 3 is controlled by the resistance mechanism 4 and its electromagnetic resistance device 40. The pulley 51 and the flywheel 41 have rotational inertia and this rotational inertia provides a means of storing energy in the flywheel 41 when then flywheel 41 is rotating. The rotational inertia in the flywheel 41 helps to moderate or minimize fluctuations in the rotational speed of the flywheel, which helps to keep the plurality of steps 3 moving smoothly.

If the plurality of steps 3 or drive mechanism 2 ever become blocked or stuck o due to an object blocking the path of the plurality of steps 3, the one-way clutch mechanism 53 on the pulley 51 would disengage the plurality of steps 3 from the flywheel 41, thus preventing the energy stored in the flywheel 41 from being transmitted into the object in the path of the plurality of steps 3. Explained another way, the pulley 51 will be idling while the upper shaft 21 gets stuck because the one-way clutch mechanism 53 will be disengaged. In this manner, if ever an accident were to occur such that an operator's foot were to get stuck in between the plurality of steps 3, the one-way clutch mechanism 53 would be disengaged such that neither the pulley 51 nor the flywheel 41 would be able to exert a torque on the upper shaft 21 and no stored energy from the flywheel 41 could be transmitted to the operator's foot or any other obstacle. Disengaging the one-way clutch mechanism 53 offers another benefit in that is decouples the plurality of steps 3 from the flywheel 41 and brake unit 43, allowing the plurality of steps 3 to be manually rotated in the upward direction even when the brake unit 43 is engaged. In this way, the plurality of steps 3 can always be rotated in the upward direction to free an obstacle, regardless of the state of engagement or disengagement of the brake unit 43, and regardless of the amount of energy stored in the flywheel 41.

As shown in FIG. 2 and FIG. 3, a pulley brake 54 is configured to stop the rotation of pulley 51 in the event that the belt 52 becomes broken or loosened. A tensioning spring 55 biases the pulley brake 54 into contact with the pulley 51 while tension in the belt 52 biases the pulley brake 54 away from coming into contact with the pulley 51. In the preferred embodiment of the present invention, the belt 52 is tensioned by the tensioning spring 55 that biases an idler roller 56 about a pivot point 57. The tensioning spring 55 has one end secured to the frame 1 and the other end secured to the pulley brake 54. The pulley brake 54 is pivotable about the pivot point 57 and biased by the tensioning spring 55 to pull on the belt 52 to retain tension in the belt 52. The pulley brake 54 has a brake block 58 pivotally mounted at one end of the pulley brake 54 opposite to the pivot point 57. An idler roller 56 is mounted to the pulley brake 54 and against the belt 52. The pulley brake 54 is pulled away from the pulley 51 by the tension of the belt 52 against the elastic force of the tensioning spring 55. If the belt 52 were broken or loosened, the tension of the belt would disappear or would be decreased, causing the pulley brake 54 to be pulled into the pulley 51 by the tensioning spring 55 to stop the pulley 51 from rotating. This safety feature ensures that the pulley 51, and therefore the plurality of steps 3, will be forced to stop moving in the event of a breakage in belt 52.

In the preferred embodiment of the present invention, the pulley brake 54 has a first arm 541 and a second arm 542 connected with each other. The first arm 541 is pivotally connected to the corresponding retaining plate 44 of the electromagnetic resistance device 40 at the pivot point 57. The second arm 542 is substantially V-shaped with two legs. The apex of the second arm 542 is connected to the first arm 541 at the end of the first arm 541 opposite to the pivot point 57. The second arm 542 may be pivotable with respect to the first arm 542, which is not limited by the present invention. The idler roller 56 is rotatably mounted to one leg of the second arm 542, and the brake block 58 is pivotally mounted to the other leg of the second arm 542, as shown in FIG. 3. The two legs of the second arm 542 may be perpendicular to one another. The belt 52 from the pulley 51 is configured to drive the rotation of the flywheel 41. The flywheel 41 is a part of the electromagnetic resistance device 40. Since rotation of the flywheel 41 is controlled by the electromagnetic resistance device 40 and since the rotation of the pulley 51 is coupled to the rotation of the flywheel 41 through the belt 52, if the belt 52 were broken, the pulley 51 would run without any resistance if there was not pulley brake 54 to stop the rotation of the pulley 51. Therefore, without a pulley brake 54 to stop rotation of the pulley 51, it would be possible for the plurality of steps 3 to revolve out of control in the event of a belt 52 breaking or becoming too loose. In order to prevent the situation, the pulley brake 54 becomes an emergency brake to prevent movement of the plurality of steps 3 in the event the belt 52 breaks or becomes loose. In another embodiment (not shown), the pulley brake 54 may be secured on the frame 1. The pulley brake 54 may be substantially fork-shaped with two legs respectively connected to the idler roller 56 and the brake block 58.

Figure 7:
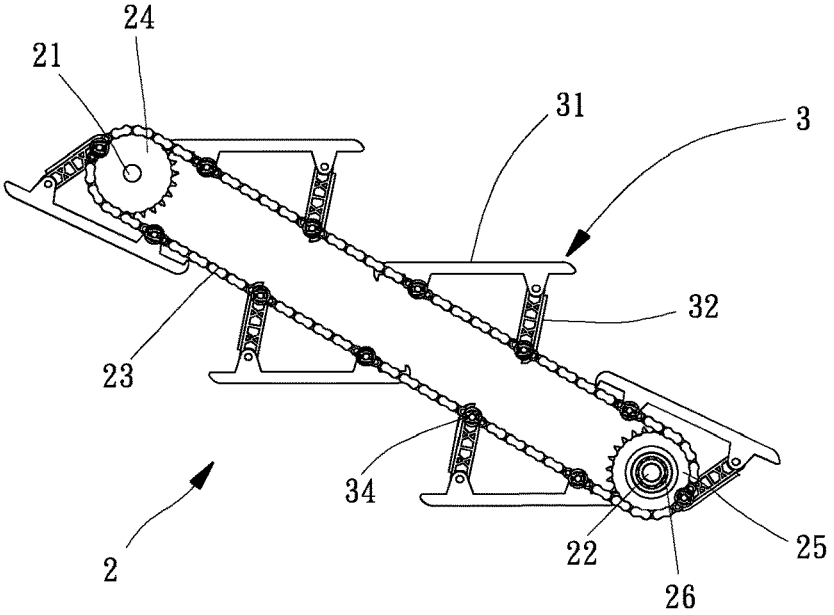
FIG. 7 is a side view of FIG. 6.

Referring to FIG. 6 and FIG. 7, the drive mechanism 2 is shown more clearly. The upper shaft 21 is connected to a pair of upper sprockets 24, and the lower shaft 22 is connected to a pair of lower sprockets 25. Each of the drive chains 23 is mounted around the respective upper sprocket 24 and the respective lower sprocket 25. In the preferred embodiment of the present invention, the upper shaft 21 is supported by the frame 1 and connected to the pulley 51, as shown in FIG. 2. The lower shaft 22 is supported by the frame 1 near the rear portion of the stair exerciser apparatus 100. There is a bearing 26 mounted in between the lower shaft 22 and each lower sprocket 25, so that each lower sprocket 25 are rotatable about a stationary lower shaft 22 that is fixed to the frame 1 to prevent rotation of the lower shaft 22, as shown in FIG. 6. As the operator applies a downward load on the plurality of steps 3 from the operator's bodyweight upon the plurality of steps 3, the drive chains 23 rotate the upper sprockets 24 and the lower sprockets 25, causing the upper shaft 21 to rotate. Rotation of the upper shaft 21 causes rotation of the pulley 51 and rotation of the flywheel 41. Under this arrangement, the rotational resistance of the flywheel 41 is controlled by the resistance mechanism 4 to adjust the downward running speed of the plurality of steps 3.

Referring to FIG. 6 through FIG. 9, each of the plurality of steps 3 consists of a tread 31 and a riser 32. The tread 31 and the riser 32 are pivotally snapped together such that the tread 31 could break away from the riser 32 if any object were to be placed in the path of the plurality of steps 3. The tread 31 has a tread surface for supporting an operator's foot as the operator steps onto one of the plurality of steps 3. Each one of the plurality of steps 3 is connected to the pair of drive chains 23 by two pivot shafts 33. One of the two pivot shaft 33 connects the tread 31 to the drive chains 23, and the other one connects the riser 32 to the drive chains 23. As shown in FIG. 6 and referring to FIG. 8, each pivot shaft 33 has two ends pivotally connected to the pair of the drive chains 23. The pair of drive chains 23 supports the plurality of steps 3 such that the plurality of steps 3 synchronously move with the pair of drive chains 23 around the upper shaft 21 and the lower shaft 22. Each pivot shaft 33 is attached with two bearing 34 at two opposite ends. Each inclined support 12 has a guide track 15 attached thereon for supporting each pivot shaft 33. Each bearing 34 is configured to move along the guide track 15 that extends along the corresponding inclined support 12 from a location near the front portion of frame 1 to a location near the rear portion of the frame 1. The corresponding inclined support 12 guides the pivot shaft 33 of the respective step of the plurality of steps 3 along an upper run of the corresponding drive chain 23, causing the upper run of the plurality of steps 3 to move downward and backward along the guide track 15, as shown in FIG. 3, such that the plurality of steps 3 travel around the inclined supports 12.

Figure 8:
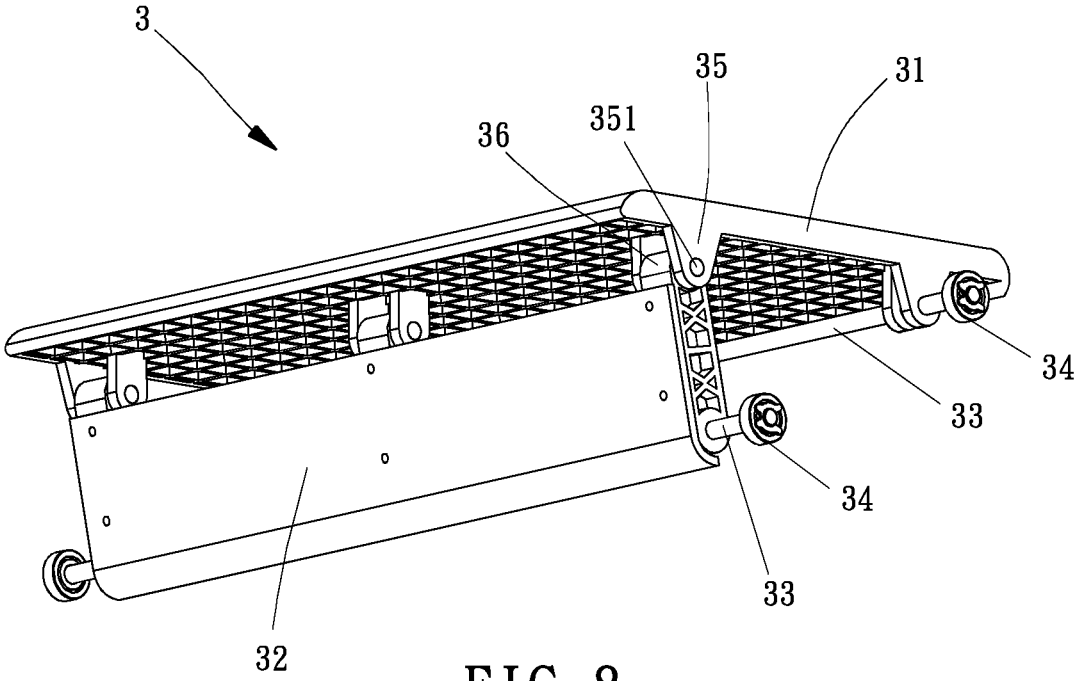
FIG. 8 is a perspective view of each step showing that the tread and the riser are snapped together.
Figure 9:
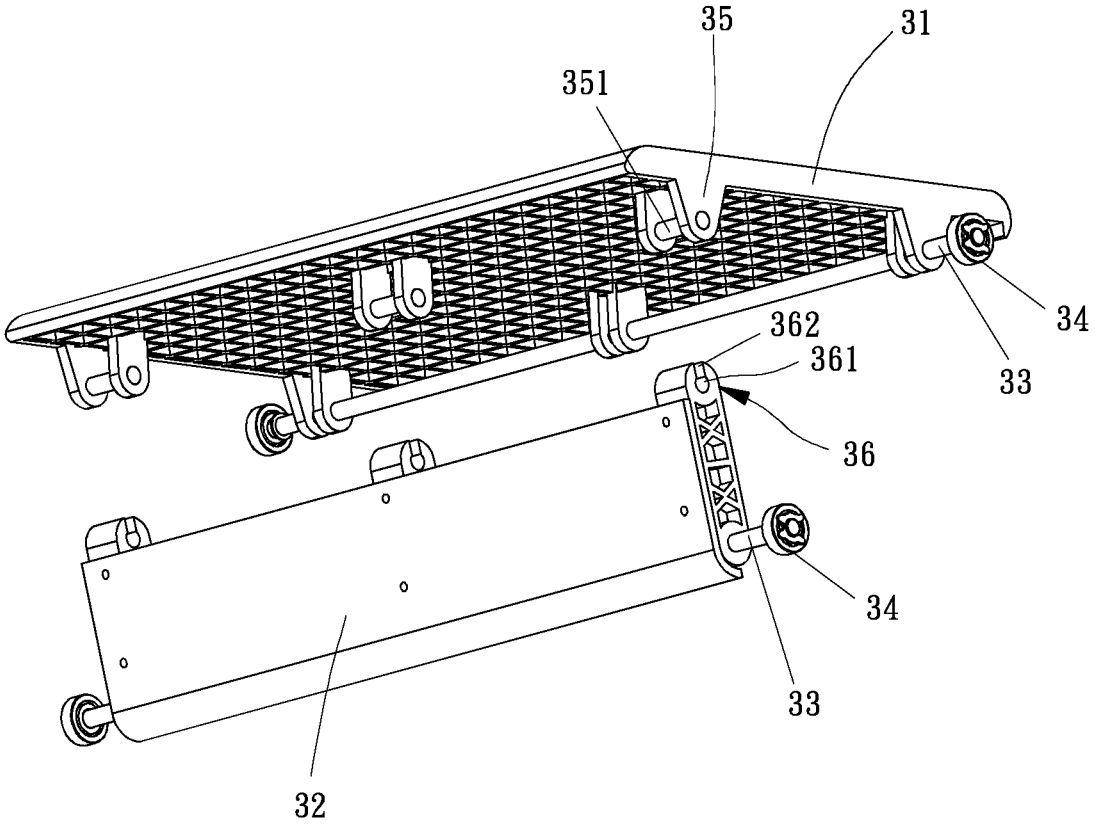
FIG. 9 illustrates the tread breaking away from the riser.

Referring to FIG. 8 and FIG. 9, the tread 31 has one or more connecting parts 35 disposed on a bottom of the tread 31 at the junction of the tread 31 and the riser 32, and the riser 32 has one or more clipping members 36 corresponding to the respective connecting parts 35 on the bottom of each tread 31. Each connecting part 35 has a connecting pin 351 laterally defined therein. Each clipping member 36 is configured to removably couple to the connecting pin 351 of the connecting part 35. Specifically, each clipping member 36 has an aperture 361 for receiving the connecting pin 351 of the corresponding connecting part 35 and an opening 362 leading between the outside of the clipping member 36 and the aperture 361. The opening 362 has a width slightly smaller than a diameter of the aperture 362 such that the connecting pin 351 may be removably coupled to the aperture 361 of the clipping member 36 while having the connecting pin 351 retained in the aperture 361 by the inner walls of the aperture 361 and the smaller width of the opening 362. In this manner, the connecting pin 351 of each connecting part 35 could be pivotally positioned in the aperture 361 of the corresponding clipping member 36 and be detached from the aperture 361 of the corresponding clipping member 36 via the opening 362. Under this arrangement, the tread 31 and the riser 32 are pivotally snapped together, so that the tread 31 could break away from the riser 32 if any object were to be placed in the path of the plurality of steps 3. For example, if an operator's foot were to get stuck in between the plurality of steps 3, the loading of the operator's foot on the tread 31 would automatically cause the tread 31 to become detached from the riser 32 immediately so as to avoid any injury to the operator. Additionally, as shown in FIG. 1, a baffle board 16 may be disposed under the plurality of steps 3 and arranged parallel to the pair of the inclined supports 12 for preventing an object from falling down between the plurality of steps 3 or falling down into the drive mechanism 2.

Figure 10:
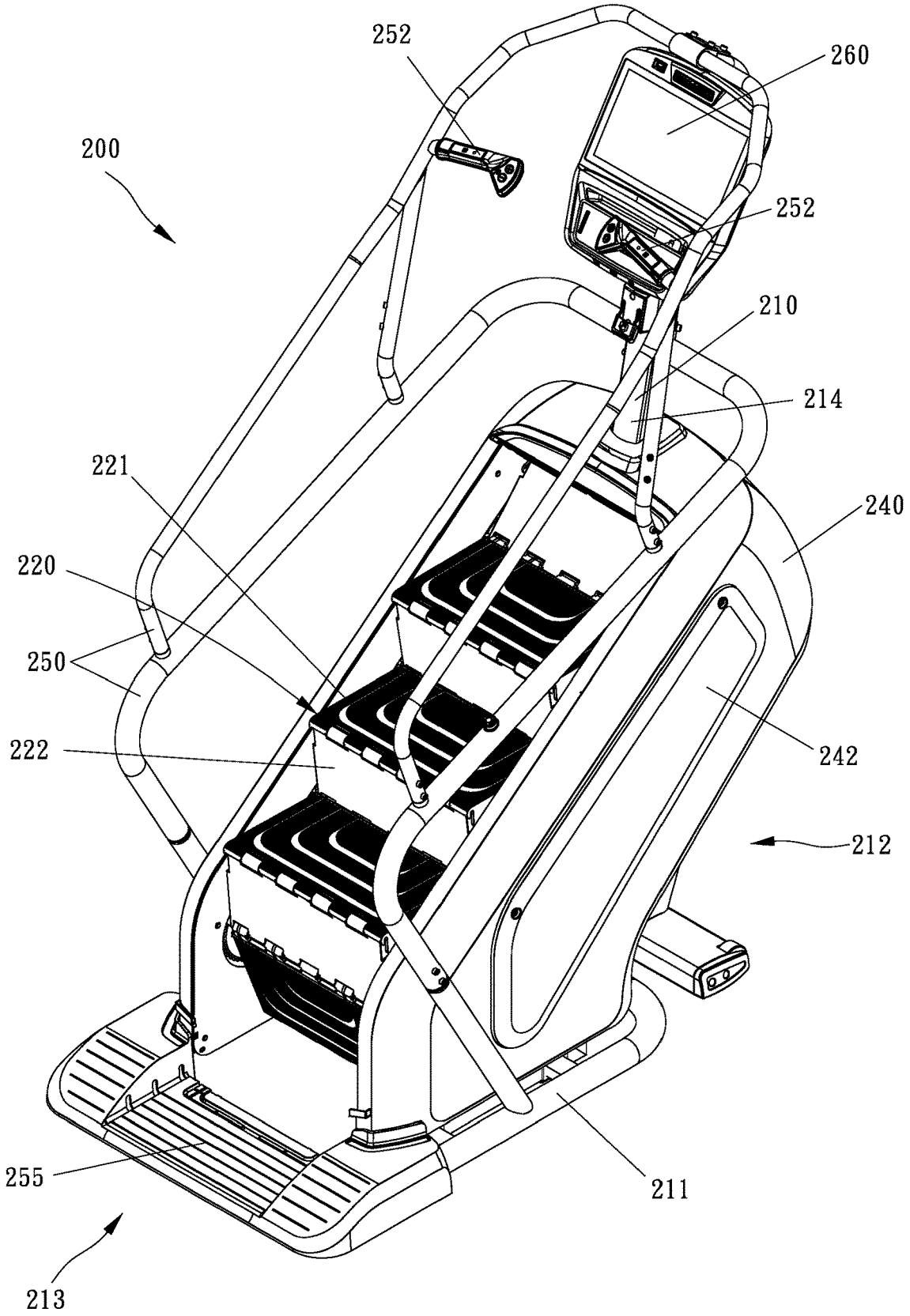
FIG. 10 is a perspective view of a stair exerciser apparatus in accordance with a second embodiment of the present invention.
Figure 11:
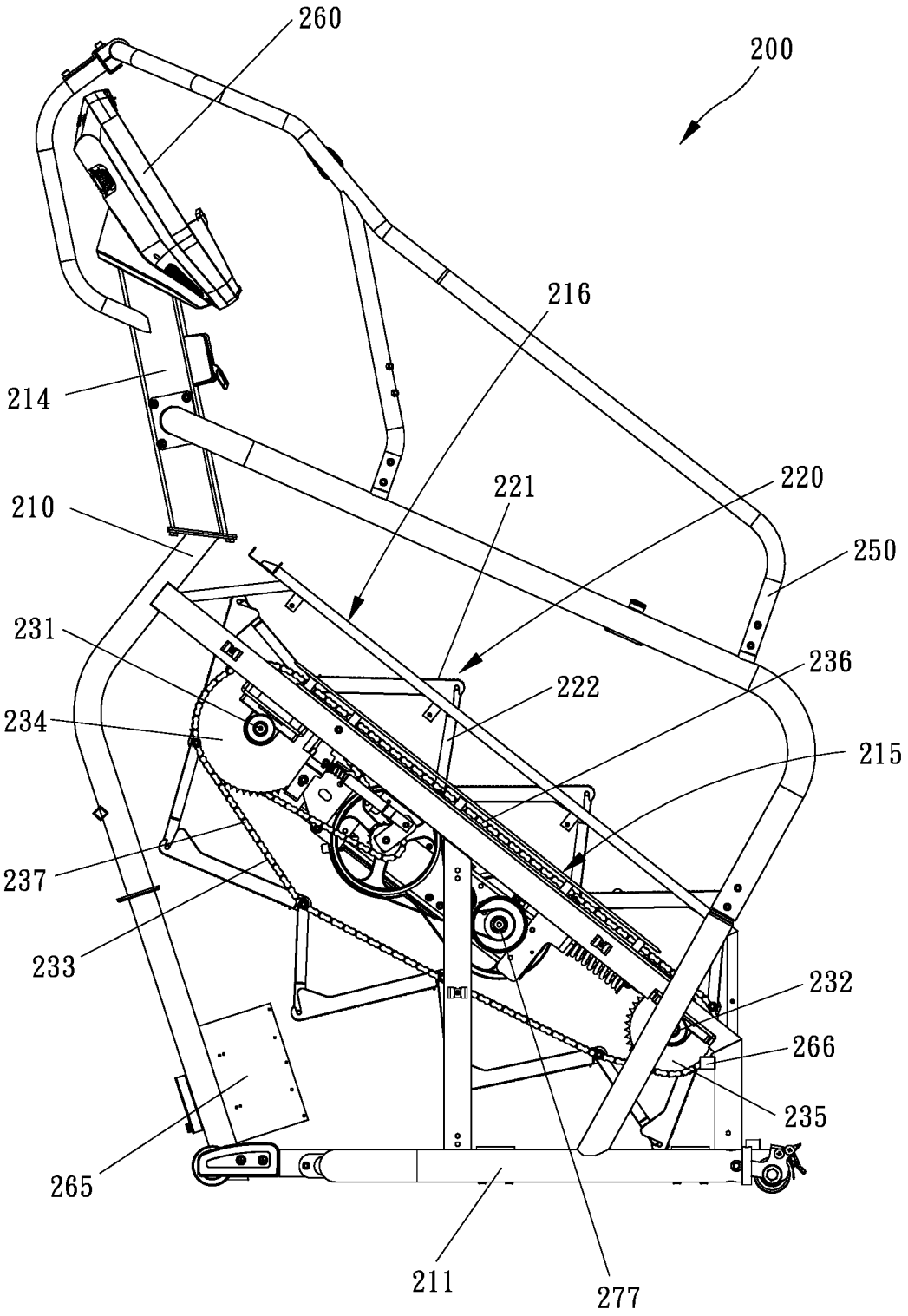
FIG. 11 is a left side view of the stair exerciser apparatus of FIG. 10.
Figure 12:
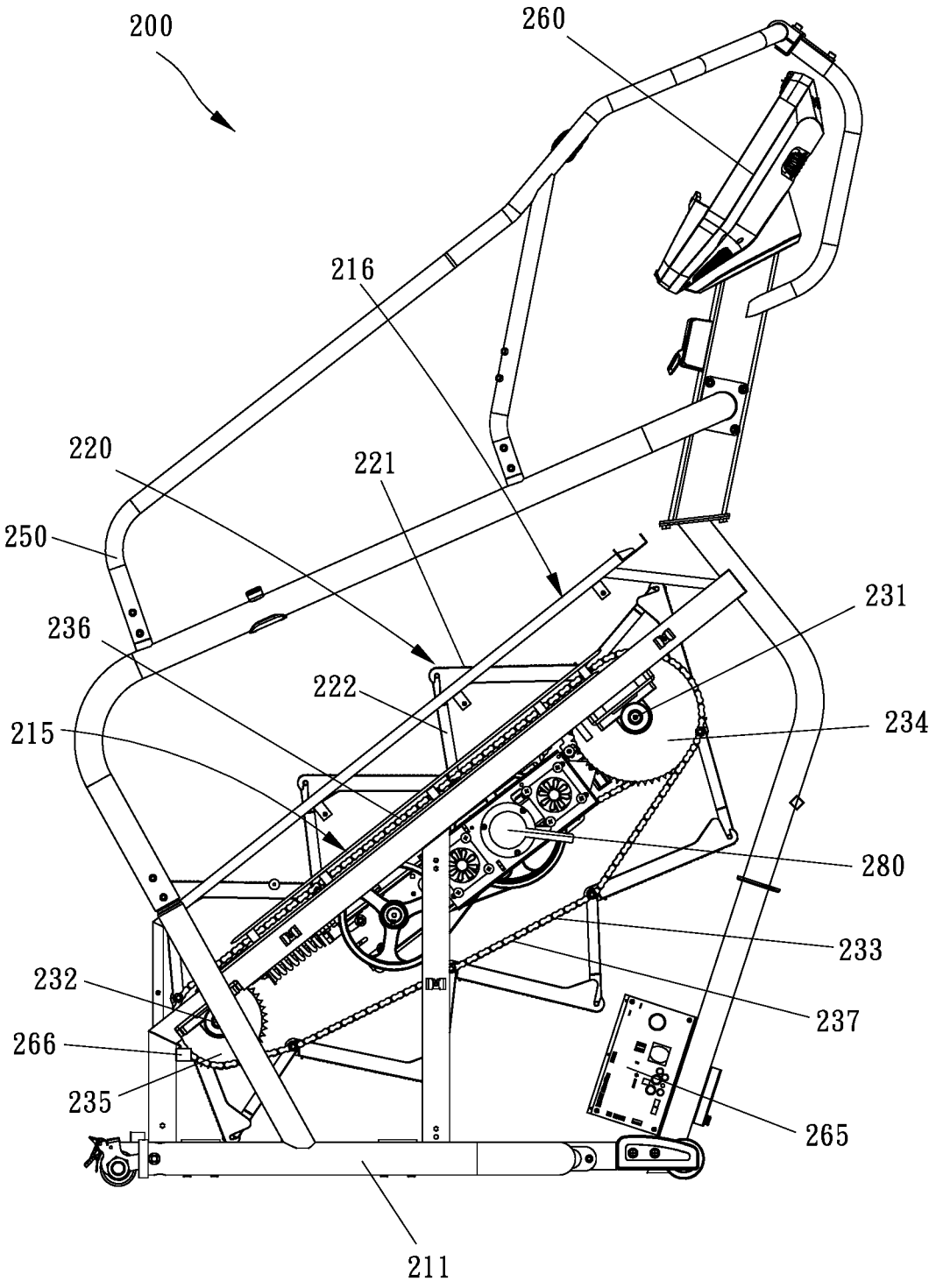
FIG. 12 is a right side view of the stair exerciser apparatus of FIG. 10.

Referring to FIG. 10 through FIG. 12, a stair exerciser apparatus 200 is illustrated in accordance with a second embodiment of the present invention. The stair exercise apparatus 200 has a frame 210, a plurality of steps 220 supported by the frame 210, the plurality of steps 220 being movable with respect to the frame 210, and a drive mechanism 230 coupled to the plurality of steps 220. The drive mechanism 230 includes an upper shaft 231 rotatably mounted to the frame 210, a lower shaft 232 rotatably mounted to the frame 210, and a pair of endless conveyors 233. The plurality of steps 220 are pivotally linked together and joined to the conveyors 233 for movement with the conveyors 233, and the plurality of steps 220 are configured to move in a downward and backward direction as the conveyors 233 revolve about the upper shaft 231 and the lower shaft 232.

The stair exerciser apparatus 200 includes a housing 240, removable access panels 242 covering side openings of the housing 240, a hand rail 250, a pair of hand grips 252 and a stationary platform 255. Each hand grip 252 has a heart rate sensor (not numbered) and control buttons (not numbered) incorporated into the hand grip 252. The control buttons on the hand grip 252 can include controls such as speed control, resistance control, start, stop, and pause. The frame 210 has a base 211 resting on a substantially horizontal support surface such as a floor, a front portion 212 defined at the front of the stair exerciser apparatus 200, and a rear portion 213 defined at the rear of the stair exerciser apparatus 200.

The stair exerciser apparatus 200 includes a mast 214 protruding upward from the front portion 212 of the frame 210. The mast 214 supports a console 260 with a display screen to provide feedback to an operator. The console 260 also includes input devices to enable an operator to provide information to the stair exerciser apparatus 200. The stationary platform 255 is located below and behind the plurality of steps 220 at the entrance to the stair exerciser apparatus 200. The stationary platform 255 provides a convenient platform for an operator to stand upon when mounting or dismounting from the stair exerciser apparatus 200.

Each of the plurality of steps 220 consists of a step platform 221 and a step riser 222. The step platforms 221 and the step risers 222 are pivotally connected to each other so that each of the plurality of steps 220 is pivotally connected to the adjacent step in the plurality of steps 220, and each of the plurality of steps 220 has a pivot connected between the step platform 221 and the step riser 222. The plurality of steps 220 are connected at the bottom of a step riser 222 by connecting pins 223, and the step platforms 221 and the step risers 222 are connected to each other at the top of a step riser 222 by guide pins 224. The connecting pins 223 are connected to the conveyors 233, so that revolution of the conveyors 233 about the upper shaft 321 and the lower shaft 232 synchronizes revolution of the plurality of steps 220 in a loop around the upper shaft 231 and the lower shaft 232.

Figure 15:
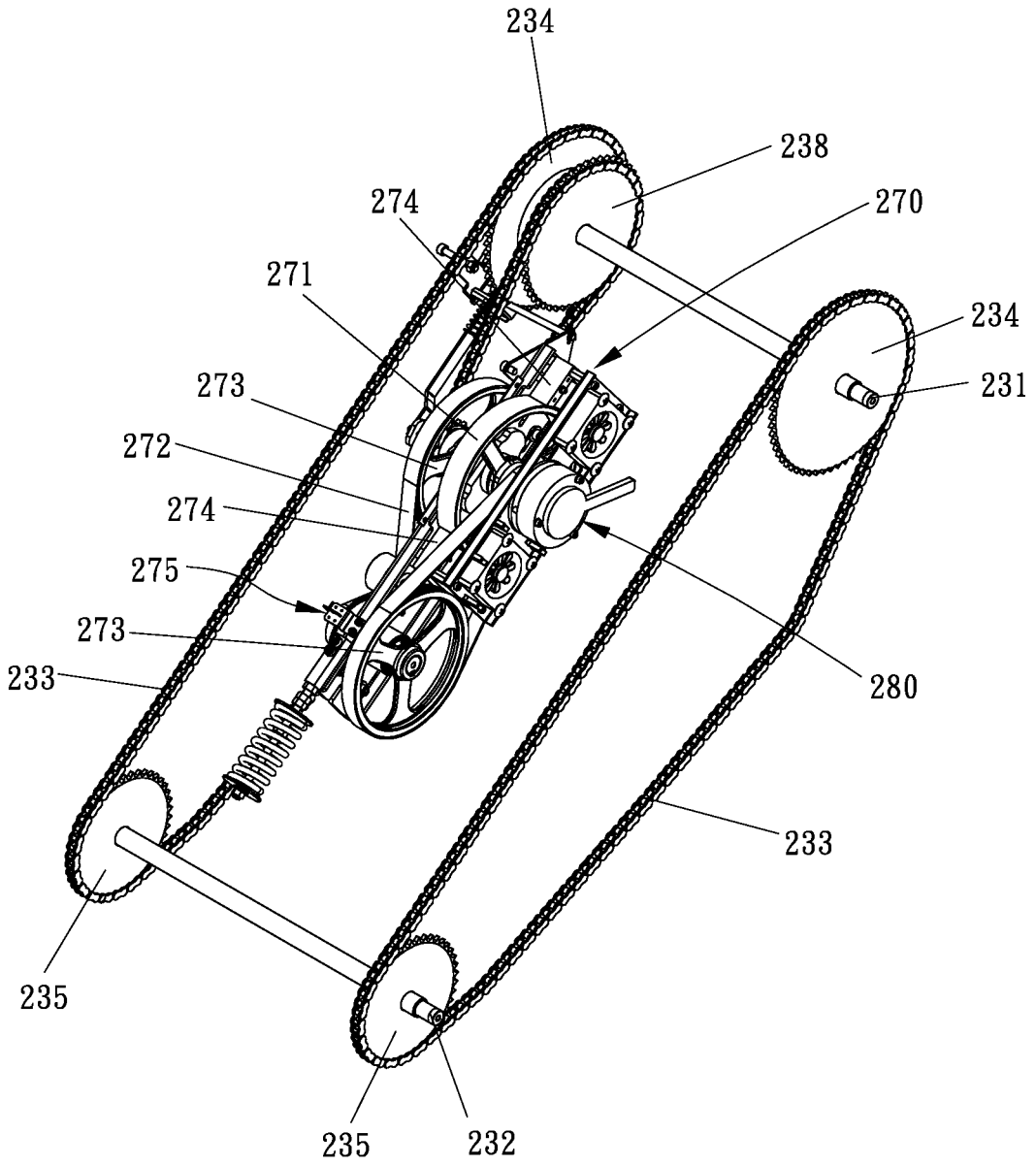
FIG. 15 is a perspective view showing the drive mechanism of the stair exerciser apparatus of the second embodiment.

Referring to FIG. 11 and FIG. 12, the stair exerciser apparatus 200 is illustrated with the covers removed to reveal internal features, and the frame 210 is shown more clearly. The frame 210 includes the base 211, the mast 214, a pair of inclined tracks 215 for supporting the conveyors 233 and the connecting pins 223 of the plurality of steps 220, and a pair of guide rails 216 for guiding the plurality of steps 220. The upper shaft 231 is rotatably mounted to the frame 210 near the front portion 212 of the frame 210, and the lower shaft 232 is rotatably mounted to the frame 210 near the rear portion 213 of the frame 210. The upper shaft 231 is connected with a pair of upper sprockets 234, and the lower shaft 232 is connected with a pair of lower sprockets 235. Each conveyor 233 revolves around the corresponding upper sprocket 234 and the corresponding lower sprocket 235. Motion of the conveyors 233 causes rotation of the upper sprockets 234, the upper shaft 231, the lower sprockets 235 and the lower shaft 232. Rotation of the upper sprockets 234 and the upper shaft 231 also causes synchronous rotation of an inner sprocket 238, as shown in FIG. 15. In the preferred embodiment of the present invention, the inner sprocket 238 is disposed next to one of the upper sprockets 234 and coupled to a flywheel 271, such that rotation of the inner sprocket 238 drives rotation of the flywheel 271. Because the plurality of steps 220 are coupled to the conveyors 233 and to the upper sprockets 234, movement of the plurality of steps 220 in a downward direction drives rotation of the flywheel 271.

Figure 13:
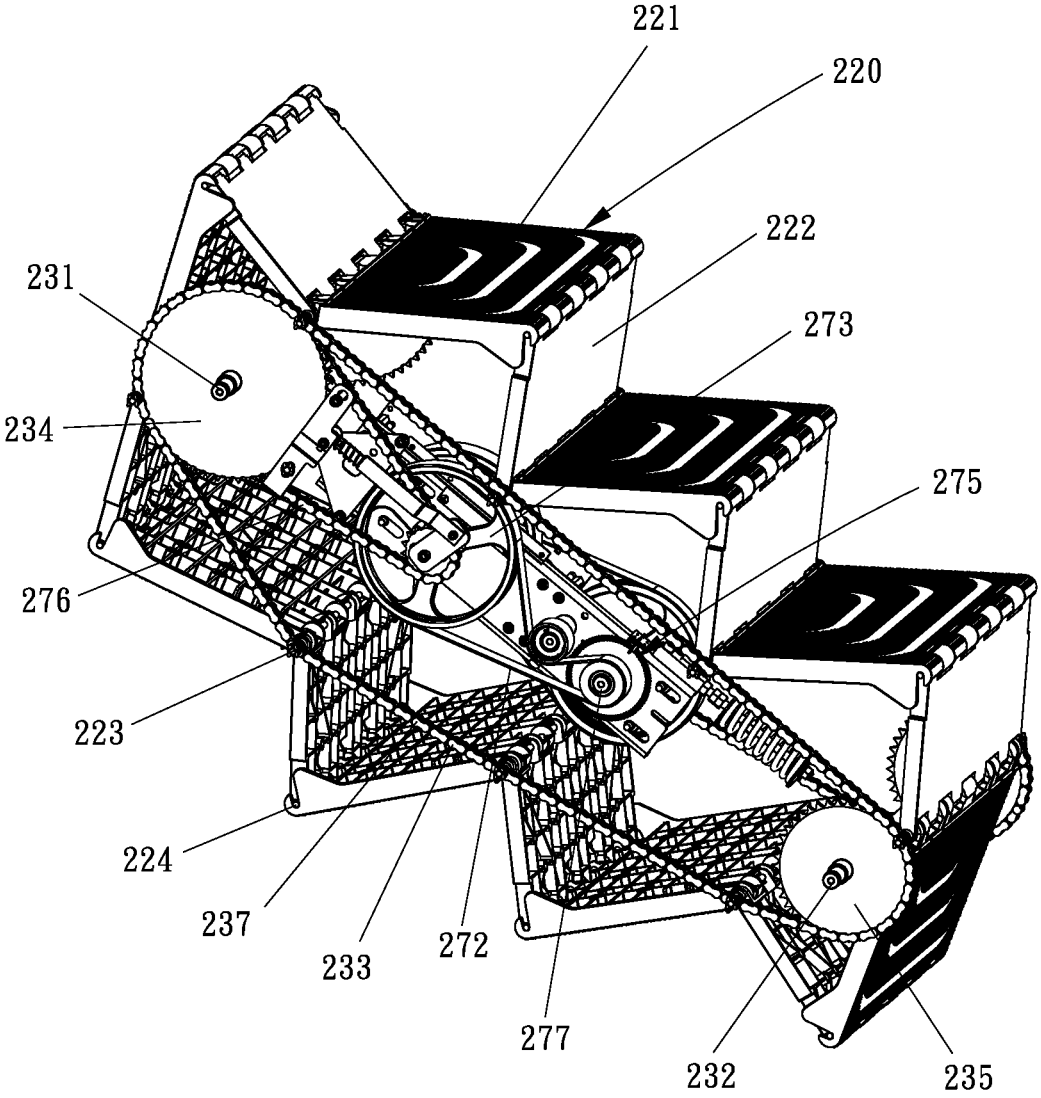
FIG. 13 is a perspective view showing the drive mechanism of the stair exerciser apparatus of the second embodiment with a plurality of steps.
Figure 14:
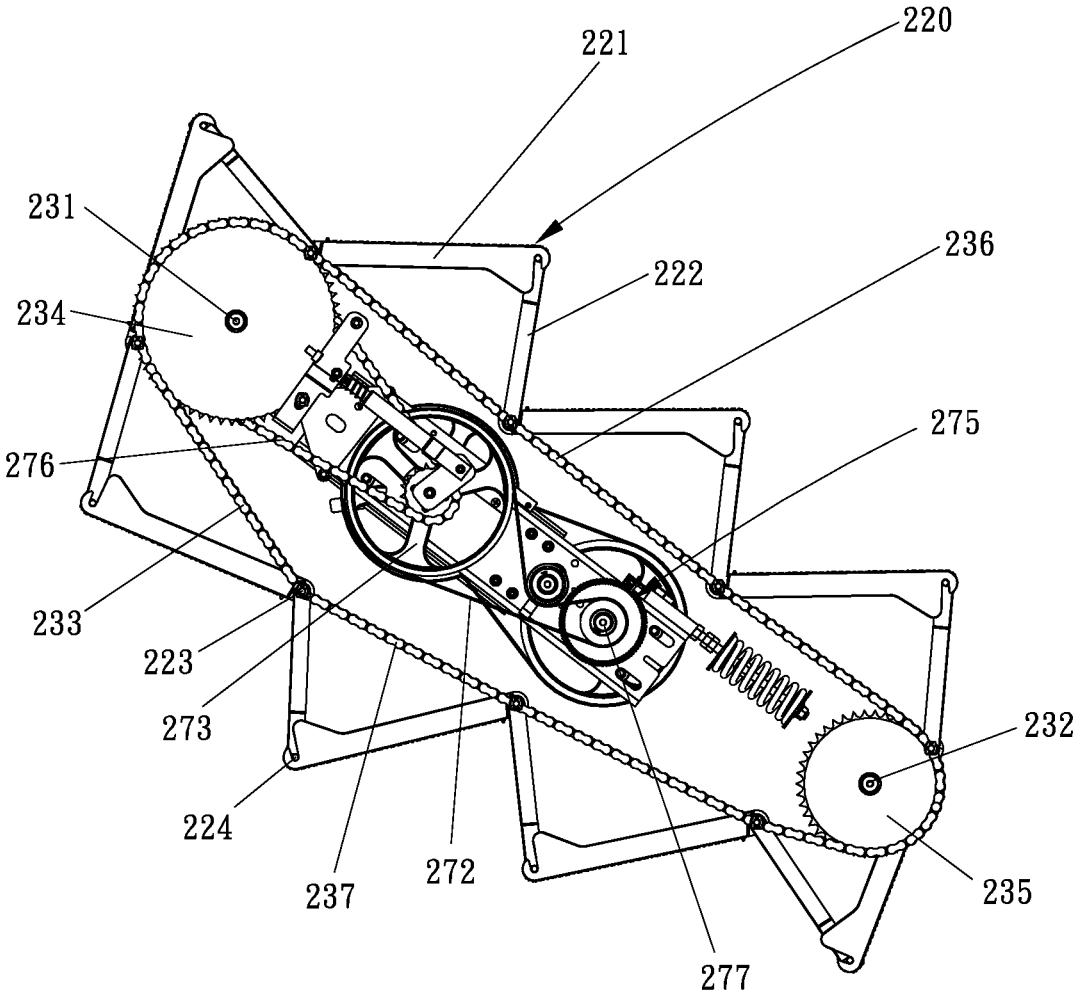
FIG. 14 is a side view of FIG. 13.

As shown in FIG. 11 and referring to FIGS. 13-14, each conveyor 233 is shown to define an upper run 236 configured to position a number of the plurality of steps 220 for exercise use, and a lower run 237 configured to be a return path for the respective conveyor 233. The inclined tracks 215 support and guide the connecting pins 223 and the upper runs 236 of the conveyors 233 as the plurality of steps 220 move downward and backward along the inclined tracks 215.

The stair exerciser apparatus 200 has a controller 265 configured to receive electrical signals from various sources such as a tachometer 275, a position sensor 266, or the console 260. As shown in FIG. 11, the controller 265 is shown as a separate unit mounted to the frame 210, but the one skill in the art will understand that the controller 265 could be located elsewhere such as embedded inside the console 260. The tachometer 275 is mounted to the drive mechanism 230 for providing an electrical signal to the controller 265 so that the controller 265 is able to calculate the rotational speed of the drive mechanism 230 for obtaining the speed of revolution of the plurality of steps 220. In the preferred embodiment of the present invention, the tachometer 275 is a rotary encoder which includes a disc and a photo sensor (not numbered). The rotary encoder is a conventional technique well known in the art, and it is not described in further detail in this specification. The position sensor 266 is mounted on the frame 210 and arranged between the frame 210 and the plurality of steps 220, as shown in FIG. 11. In the preferred embodiment of the present invention, the position sensor 266 is a proximity sensor for detecting when the plurality of steps 220 are positioned at set location. The position sensor 266 provides position information to the controller 265, where the position information informs the controller 265 of the relative position of the plurality of steps 220 along the cyclic path followed by the plurality of steps 220 and the conveyors 233.

As shown in FIG. 15 and referring to FIGS. 11-12, the stair exerciser apparatus 200 further includes a braking mechanism 270 mounted onto the frame 210 adjacent to the flywheel 271. In the preferred embodiment of the present invention, the flywheel 271 is coupled to the upper shaft 231 by belts 272 and pulleys 273 through a transmission chain 276 to the inner sprocket 238 and the upper shaft 231. When the plurality of steps 220 of the stair exerciser apparatus 200 are driven downward by an external load, such as the weight of an operator standing upon one or more of the plurality of steps 220, the conveyors 233 revolve about the upper shaft 231 and the lower shaft 232, causing the upper shaft 231 to rotate. The rotation of the upper shaft 231 drives the rotation of the flywheel 271. As the flywheel 271 rotates, the braking mechanism 270 provides an opposing torque to the flywheel 271, thereby slowing down the rotation of the flywheel 271 and the speed of the plurality of steps 220. In the preferred embodiment of the present invention, the braking mechanism 270 is an induction brake which includes a pair of electromagnets 274 disposed at two opposite sides of the flywheel 271 for electrically controlling the rotational resistance of the flywheel 271. The braking mechanism 270 is operatively controlled by the controller 265, setting the amount of rotational resistance to the flywheel 271 such that the speed of the plurality of steps 220 is controlled. In another embodiment, the braking mechanism may be a friction brake, an eddy current brake (ECB), or any other brake that is known in the art.

A locking mechanism 280 is operatively engaged with the conveyors 233. In the preferred embodiment of the present invention, the locking mechanism 280 is coupled with the braking mechanism 270 and engaged with the conveyors 233. The locking mechanism 280 is coaxially coupled to the flywheel 273 and electrically coupled to the controller 265 so that the locking mechanism 280 is controlled by the controller 265 to lock the flywheel 273 in a stationary position to prevent motion of the flywheel 273 and the plurality of steps 230 when locking mechanism 280 is engaged. The locking mechanism 280 is coupled to the plurality of steps 230 and is configured to prevent the upper shaft 231 from rotating and to prevent the plurality of steps 220 from moving when the locking mechanism 280 is engaged. When the plurality of steps 220 are stationary, the locking mechanism 280 is engaged by the controller 265 to ensure the plurality of steps 220 remain stationary, so that the operator is able to step onto the plurality of steps 220 or step from the plurality of steps 220 to the stationary platform 255 without risk of unintended motion of the plurality of steps 220.

Referring to FIG. 13 and FIG. 14, a one-way clutch mechanism 277 is operatively engaged with the conveyor 233 and the flywheel 271. The one-way clutch mechanism 277 selectively couples the conveyor 233 with the flywheel 271 such that motion of the plurality of steps 220 in a first step direction (namely the downward direction) drives rotation of the flywheel 271 when the one-way clutch mechanism 277 is engaged. The one-way clutch mechanism 277 selectively decouples the conveyor 233 from the flywheel 271 when the one-way clutch mechanism 277 is disengaged such that motion of the plurality of steps 220 does not drive rotation of the flywheel 271. For example, when the plurality of steps 220 are moved in a second step direction (namely the upward direction), the one-way clutch mechanism 277 automatically becomes disengaged so as to decouple the plurality of steps 220 from the flywheel 271, preventing any energy stored in the rotation of the flywheel 271 from being transmitted to the plurality of steps 220. Due to the one-way clutch mechanism 277, motion of the plurality of steps 220 in the first step direction (namely the downward direction) drives the rotation of the flywheel 271, but rotation of the flywheel 271 cannot drive motion of the plurality of steps 220. The one-way clutch mechanism selectively decouples the conveyor 233 from the flywheel 271 such that energy stored in the rotation of the flywheel 271 is prevented from being transmitted to an object that by its presence prevents motion of the plurality of steps in the first step direction.

During operation of the stair exerciser apparatus 200, the plurality of steps 220 are driven downward by the weight of the operator such that the plurality of steps 220 move in the first step direction, and movement of the plurality of steps 220 in the first step direction further drives the rotation of the flywheel 271 since the one-way clutch mechanism 277 is engaged at this time, namely the plurality of steps 220 are coupled to the flywheel 271. The downward running speed of the plurality of steps 220 is controlled by controlling the resistance to the rotational speed of the flywheel 271.

When an operator steps off of the plurality of steps 220, the one-way clutch mechanism 277 becomes disengaged and the plurality of steps 220, with no external loads on them, will quickly stop moving, regardless of the rotational motion or lack of rotational motion of the flywheel 271. The locking mechanism 280 will be actuated to stop rotation of the plurality of steps 220 and to immediately lock them in a stationary position for safe mounting of the plurality of steps 220 by an operator. In the preferred embodiment of the present invention, since the one-way clutch mechanism 277 is arranged between the drive mechanism 230 and the flywheel 271, the motion of the plurality of steps 220 is selectively decoupled from the rotation of the flywheel 271. In this manner, when the rotational speed of the plurality of steps 220 is relatively slower than the rotational speed of the flywheel 271, or when the plurality of steps 220 are moved in a second step direction opposite to the direction of motion (namely the first step direction) which drives the rotation of the flywheel 271, the one-way clutch mechanism 277 is operative to decouple the plurality of steps 220 from the flywheel 271. Furthermore, as shown in FIG. 13, the disc of the tachometer 275 is rotated along with rotation of the plurality of steps 220 such that the tachometer 275 is able to immediately detect the rotational speed of the plurality of steps 220 regardless of the rotation of the flywheel 271 since the disc of the tachometer 275 is coupled with the plurality of steps 220 and since the one-way clutch mechanism 277 decouples the plurality of steps 220 from the flywheel 271.

In one example, if the operator were to suddenly jump off of the stair exerciser apparatus 200, the plurality of steps 220 will be no longer driven by the weight of the operator. The plurality of steps 220 will quickly cease their revolutions around the upper shaft 231 and the lower shaft 232, and once the tachometer 275 detects the suddenly drop of the rotational speed of the plurality of steps 220, the locking mechanism 280 will be actuated to immediately stop rotation of the plurality of steps 220 and to lock the plurality of steps 220 into a stationary position. Preferably, when the tachometer 275 detects the suddenly drop of the rotational speed of the plurality of steps 220, the resistance of the braking mechanism 270 is applied to the flywheel 271 to also stop rotation of the flywheel 271 such that both the plurality of steps 220 and the flywheel 271 will be stopped. The locking mechanism 280 is actuated to lock the flywheel 271 to prevent unintended rotation of the plurality of steps 220 in the first step direction. Once the flywheel 271 is locked, the plurality of steps 220 are prevented from moving in the first direction (namely in the downward direction), but the upward movement of the plurality of steps 220 is not restricted. In other words, the locking mechanism 280 prevents motion of the plurality of steps 220 in the first step direction, but motion of the plurality of steps 220 in the second step direction is not restricted. Once the locking mechanism 280 is released and a downward load is applied to the plurality of steps 220, the one-way clutch mechanism 277 again engages the plurality of steps 220 with the flywheel 271.

In one preferred embodiment, a flywheel speed sensor (not shown) is disposed near the flywheel 271 to sense a rate of rotation of the flywheel 271 and to generate flywheel speed data, and a conveyor speed sensor (such as the tachometer in the aforementioned embodiment) is disposed to sense a motion speed of the plurality of steps 220 and to generate step speed data. The braking mechanism 270 is operatively engaged with the flywheel 271 and the controller 265 is operatively engaged with the braking mechanism 270, the flywheel speed sensor and the conveyor speed sensor. The controller 265 receives the flywheel speed data from the flywheel speed sensor and the step speed data from the conveyor speed sensor. The controller 265 is able to determine a parameter indicative of whether the one-way clutch mechanism 277 is engaged or disengaged based on the flywheel speed data and the step speed data. The controller 265 engages the braking mechanism 270 to slow the rate of rotation of the flywheel 271 if the parameter indicates that the one-way clutch mechanism 277 is disengaged, namely the controller 265 determines from the flywheel speed data and the step speed data that the motion of the plurality of steps 22 is no longer driving the rotation of the flywheel 271 due to the one-way clutch mechanism 277 being disengaged.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A stair exerciser apparatus for simulating stair climbing, comprising:

a frame having a base, a front portion, and a rear portion;

a lower shaft rotatably mounted on the rear portion of the frame and an upper shaft rotatably mounted on the frame located above and forward of the lower shaft;

a conveyor operatively engaged with the upper shaft and the lower shaft;

a plurality of steps joined to the conveyor for movement with the conveyor, each of the plurality of steps is made up of a step platform and a riser pivotably joined to the step platform;

a flywheel operatively engaged with the conveyor; and a one-way clutch mechanism operatively engaged with the conveyor and the flywheel, the one-way clutch mechanism selectively coupling the conveyor with the flywheel such that motion of the plurality of steps in a first step direction drives rotation of the flywheel when the one-way clutch mechanism is engaged, the one-way clutch mechanism decoupling the conveyor from the flywheel when the one-way clutch mechanism is disengaged.

2. A stair exerciser apparatus as recited in claim 1, further comprising a locking mechanism operatively engaged with the conveyor.

3. A stair exerciser apparatus as recited in claim 1, the one-way clutch mechanism selectively decoupling the conveyor from the flywheel such that motion of the plurality of steps in a second step direction does not drive rotation of the flywheel.

4. A stair exerciser apparatus as recited in claim 1, further comprising a locking mechanism operatively engaged with the conveyor, the one-way clutch mechanism selectively decoupling the conveyor from the flywheel such that engaging the locking mechanism prevents motion of the plurality of steps in the first step direction regardless of the rotation of the flywheel.

5. A stair exerciser apparatus as recited in claim 1, further comprising a locking mechanism operatively engaged with the conveyor, the flywheel having the ability to store energy based on a rate of rotation of the flywheel, the one-way clutch mechanism selectively decoupling the conveyor from the flywheel such that engaging the locking mechanism prevents motion of the plurality of steps in the first step direction without first requiring dissipation of the energy stored in the rotation of the flywheel.

6. A stair exerciser apparatus as recited in claim 1, further comprising a locking mechanism operatively engaged with the conveyor such that engaging the locking mechanism prevents motion of the plurality of steps in the first step direction, the flywheel having the ability to store energy based on a rate of rotation of the flywheel, the one-way clutch mechanism selectively decoupling the conveyor from the flywheel such that the energy stored in the rotation of the flywheel is prevented from being transmitted to the locking mechanism when the locking mechanism is engaged to prevent motion of the plurality of steps in the first step direction.

7. A stair exerciser apparatus as recited in claim 1, the flywheel having the ability to store energy based on a rate of rotation of the flywheel, the one-way clutch mechanism selectively decoupling the conveyor from the flywheel such that the energy stored in the rotation of the flywheel is prevented from being transmitted to an object that by its presence prevents motion of the plurality of steps in the first step direction.

8. A stair exerciser apparatus as recited in claim 1, further comprising:

a braking mechanism operatively engaged with the flywheel;

a flywheel speed sensor disposed to sense a rate of rotation of the flywheel and to generate flywheel speed data;

a conveyor speed sensor disposed to sense a motion speed of the plurality of steps and to generate step speed data; and a controller for receiving the flywheel speed data from the flywheel speed sensor and the step speed data from the conveyor speed sensor, the controller operatively engaged with the braking mechanism, the controller determining a parameter indicative of whether the one-way clutch mechanism is engaged or disengaged based upon the flywheel speed data and the step speed data, the controller engaging the braking mechanism to slow the rate of rotation of the flywheel if the parameter indicates that the one-way clutch mechanism is disengaged.

9. A stair exerciser apparatus as recited in claim 1, further comprising a locking mechanism operatively engaged with the conveyor and the one-way clutch mechanism such that engaging the locking mechanism prevents motion of the plurality of steps in the first step direction while the one-way clutch mechanism allows motion of the plurality of steps in a second step direction.

10. A stair exerciser apparatus as recited in claim 1, further comprising a locking mechanism operatively engaged with the conveyor and the one-way clutch mechanism such that the plurality of steps is movable in a second step direction regardless of whether the locking mechanism is engaged to prevent motion of the plurality of steps in the first step direction.

11. A stair exerciser apparatus for simulating stair climbing, comprising:

a frame having a base, a front portion, and a rear portion;

a lower shaft rotatably mounted on the frame rear portion and an upper shaft rotatably mounted on the frame located above and forward of the lower shaft;

a conveyor operatively engaged with the upper shaft and the lower shaft;

a plurality of steps joined to the conveyor for movement with the conveyor, each of the plurality of steps is made up of a step platform and a riser pivotably joined to the step platform;

a locking mechanism operatively engaged with the conveyor; and a one-way clutch mechanism operatively engaged with the conveyor and the locking mechanism, the one-way clutch mechanism coupling the conveyor with the locking mechanism in a first rotational direction to prevent motion of the plurality of steps in a first step direction when the locking mechanism is engaged, the one-way clutch mechanism decoupling the conveyor from the locking mechanism in a second rotational direction to allow motion of the plurality of steps in a second, opposite step direction regardless of whether the locking mechanism is engaged or disengaged.

12. A stair exerciser apparatus as recited in claim 11, further comprising a flywheel operatively engaged with the conveyor, the one-way clutch mechanism coupling the conveyor with the flywheel in the first rotational direction such that motion of the plurality of steps in the first step direction drives rotation of the flywheel, the one-way clutch mechanism decoupling the conveyor from the flywheel in the second rotational direction such that motion of the plurality of steps is not driven by the rotation of the flywheel.

13. A stair exerciser apparatus as recited in claim 11, further comprising a flywheel operatively engaged with the conveyor, the one-way clutch mechanism decoupling the conveyor from the flywheel in the second rotational direction such that engaging the locking mechanism prevents motion of the plurality of steps in the first step direction regardless of the rotation of the flywheel.

14. A stair exerciser apparatus as recited in claim 11, further comprising a flywheel operatively engaged with the conveyor, the flywheel having the ability to store energy based on a rate of rotation of the flywheel, the one-way clutch mechanism selectively decoupling the conveyor from the flywheel such that engaging the locking mechanism prevents motion of the plurality of steps in the first step direction without first requiring dissipation of the energy stored in the rotation of the flywheel.

15. A stair exerciser apparatus as recited in claim 11, further comprising a flywheel operatively engaged with the conveyor, the flywheel having the ability to store energy based on a rate of rotation of the flywheel, the one-way clutch mechanism selectively decoupling the conveyor from the flywheel such that the energy stored in the rotation of the flywheel is prevented from being transmitted to an object that by its presence prevents motion of the plurality of steps in the first step direction.

16. A stair exerciser apparatus as recited in claim 11, further comprising:

a flywheel operatively engaged with the conveyor, the one-way clutch mechanism coupling the conveyor with the flywheel in the first rotational direction;

a braking mechanism operatively engaged with the flywheel;

a flywheel speed sensor disposed to sense a rate of rotation of the flywheel and to generate flywheel speed data;

a conveyor speed sensor disposed to sense a motion speed of the plurality of steps and to generate step speed data; and a controller for receiving the flywheel speed data from the flywheel speed sensor and the step speed data from the conveyor speed sensor, the controller operatively engaged with the braking mechanism, the controller determining a parameter indicative of whether the one-way clutch mechanism is engaged or disengaged based upon the flywheel speed data and the step speed data, the controller engaging the braking mechanism to slow the rate of rotation of the flywheel if the parameter indicates the one-way clutch mechanism is disengaged.

17. A stair exerciser apparatus as recited in claim 11, the locking mechanism operatively engaged with the conveyor and the one-way clutch mechanism such that engaging the locking mechanism prevents motion of the plurality of steps in the first step direction while the one-way clutch mechanism allows motion of the plurality of steps in the second step direction.

18. A stair exerciser apparatus as recited in claim 11, the locking mechanism operatively engaged with the conveyor and the one-way clutch mechanism such that the plurality of steps is movable in the second step direction regardless of whether the locking mechanism is engaged to prevent motion of the plurality of steps in the first step direction.

19. A stair exerciser apparatus for simulating stair climbing, comprising:

a frame having a base, a front portion, and a rear portion;

a lower shaft rotatably mounted on the frame rear portion and an upper shaft rotatably mounted on the frame located above and forward of the lower shaft;

a conveyor operatively engaged with the upper shaft and the lower shaft;

a plurality of steps joined to the conveyor for movement with the conveyor, each of the plurality of steps is made up of a step platform and a riser pivotably joined to the step platform;

a braking mechanism operatively engaged with the conveyor;

a locking mechanism operatively engaged with the conveyor;

a controller for selectively engaging the locking mechanism and the braking mechanism to adjust and control the braking mechanism and the locking mechanism for bringing the plurality of steps to a controlled stop; and a one-way clutch mechanism operatively engaged with the conveyor and the locking mechanism, wherein the one-way clutch mechanism couples the locking mechanism to the conveyor to prevent motion of the plurality of steps in said first step direction when the locking mechanism is engaged, and wherein the one-way clutch mechanism decouples the locking mechanism from the conveyor to allow motion of the plurality of steps in said second step direction regardless of whether the locking mechanism is engaged or disengaged.

20. A stair exerciser apparatus as recited in claim 19, further comprising:

a flywheel operatively engaged with the conveyor, the one-way clutch mechanism coupling the conveyor with the flywheel in the first rotational direction;

a flywheel speed sensor disposed to sense a rate of rotation of the flywheel and to generate flywheel speed data; and a conveyor speed sensor disposed to sense a motion speed of the plurality of steps and to generate step speed data; wherein the braking mechanism is operatively engaged with the flywheel and the controller is operatively engaged with the braking mechanism, the flywheel speed sensor and the conveyor speed sensor, and wherein the controller receives the flywheel speed data and the step speed data, the controller engages the braking mechanism to slow the rate of rotation of the flywheel if the controller determines from the flywheel speed data and from the step speed data that the motion of the plurality of steps is no longer driving the rotation of the flywheel due to the one-way clutch mechanism being disengaged.

* * * * *